US006286724B1

(12) United States Patent
Midden

(10) Patent No.: US 6,286,724 B1
(45) Date of Patent: Sep. 11, 2001

(54) LOCK STRUCTURE FOR A COLD DRINK SYSTEM

(75) Inventor: William E. Midden, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 09/439,820

(22) Filed: Nov. 12, 1999

(51) Int. Cl.[7] ..... B67B 5/00
(52) U.S. Cl. ..... 222/153.14; 222/1; 251/90
(58) Field of Search ..... 251/90, 101, 107, 251/108; 137/385, 382; 222/505, 1, 153

(56) References Cited

U.S. PATENT DOCUMENTS

| | | | | |
|---|---|---|---|---|
| 999,983 | * | 8/1911 | Gardner | 251/90 |
| 1,067,549 | * | 7/1913 | Quigley | 251/90 |
| 1,145,278 | * | 7/1915 | Taylor | 251/90 |
| 1,380,675 | * | 6/1921 | Myers | 251/90 |
| 1,473,774 | * | 11/1923 | Leech, Jr. | 251/90 |
| 1,947,081 | * | 2/1934 | Grady et al. | 251/90 |
| 3,255,938 | | 6/1966 | Dimmich et al. . | |
| 3,532,111 | * | 10/1970 | Hansen | 251/90 |
| 4,681,134 | * | 7/1987 | Paris, Sr. | 137/385 |
| 5,394,715 | * | 3/1995 | Guerette | 251/90 |
| 6,058,721 | * | 5/2000 | Midden et al. | 222/1 |

FOREIGN PATENT DOCUMENTS

92A002700 11/1992 (IT) .

* cited by examiner

*Primary Examiner*—Kevin Shaver
*Assistant Examiner*—Thach H Bui
(74) *Attorney, Agent, or Firm*—Barnes & Thornburg

(57) ABSTRACT

A cold drink system for chilling a liquid include a hopper for retaining a quantity of liquid and a hopper cover for covering a mouth of the hopper. A dispensing faucet is connected to the hopper for dispensing liquid therefrom. Structure is provided for locking the dispensing faucet to prevent actuation thereof by an unauthorized user. In addition, structure is provided for retaining the hopper cover on the hopper to deter an unauthorized user from attempting to remove the hopper cover from the hopper.

22 Claims, 5 Drawing Sheets

LOCK STRUCTURE FOR A COLD DRINK SYSTEM

BACKGROUND OF THE INVENTION

This invention is generally directed to a lock structure for a cold drink system which deters or prevents an unauthorized user from trying to obtain or from obtaining access to a chilled liquid within the cold drink system.

The cold drink system on which the present invention is used, is used to produce chilled beverages. A variety of chilled beverages can be produced by the cold drink system, including frozen or slush beverages, chilled juice drinks, milkshakes, etc.

The cold drink system includes a hopper for retaining a quantity of liquid or beverage and a chilling structure for chilling the liquid to form a chilled beverage. Some form of agitating or mixing structure, such as a blade or auger, is provided which moves relative to the chilling portion to circulate the beverage along the chilling portion and within the hopper. Circulation of the beverage along the chilling portion helps to reduce the temperature of the beverage. A hopper cover is positioned over the open upper end of the hopper and is removable therefrom so that the hopper can be cleaned and the internal components serviced. A dispensing faucet is provided for dispensing chilled beverage from the hopper.

The present invention provides a lock structure for such a cold drink system which deters or/prevents an unauthorized user from trying to obtain or from obtaining access to a chilled liquid within the cold drink system. Other features and advantages of the present invention will become apparent upon a reading of the attached specification in combination with a study of the drawings.

OBJECTS AND SUMMARY OF THE INVENTION

A general object of the present invention is to provide a lock structure for a cold drink system which deters or prevents an unauthorized user from trying to obtain or from obtaining access to a chilled liquid within the cold drink system.

An object of the present invention is to provide a lock structure for locking a dispensing faucet provided on the cold drink system to prevent actuation thereof by an unauthorized user.

Another object of the present invention is to provide a lock structure for retaining the hopper cover on the hopper to deter an unauthorized user from attempting to remove the hopper cover from the hopper.

Briefly, and in accordance with the foregoing, the present invention discloses structure for a cold drink system which deters or prevents an unauthorized user from trying to obtain or from obtaining access to a chilled liquid within the cold drink system. The cold drink system includes a hopper for retaining a quantity of liquid and a hopper cover for covering a mouth of the hopper. A dispensing faucet is connected to the hopper for dispensing liquid therefrom. Structure is provided for locking the dispensing faucet to prevent actuation thereof by an unauthorized user. In addition, structure is provided for retaining the hopper cover on the hopper to deter an unauthorized user from attempting to remove the hopper cover from the hopper.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
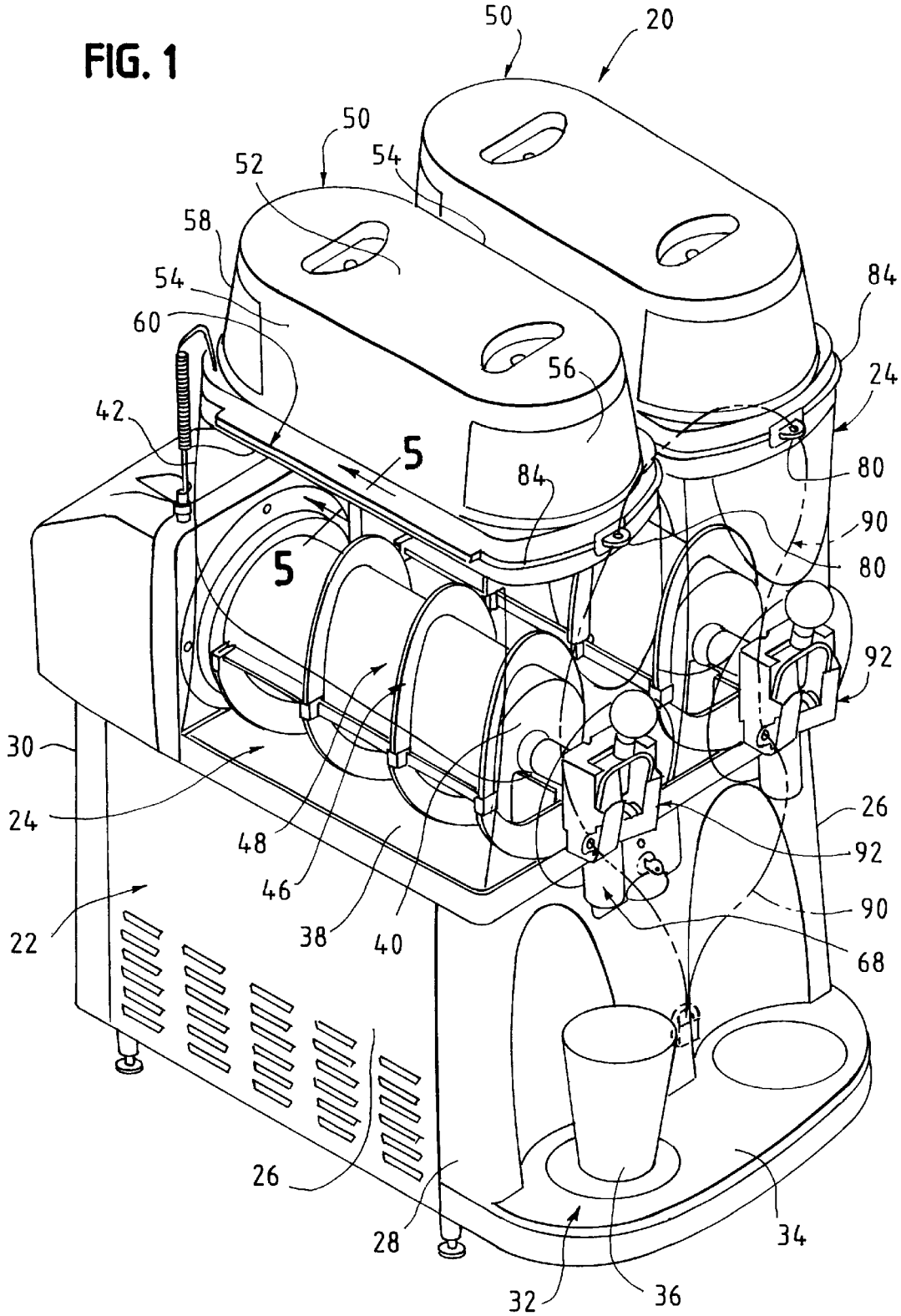
FIG. 1 is a perspective view of a cold drink system which has a lock structure mounted thereon which incorporates the features of the invention.
Figure 2:
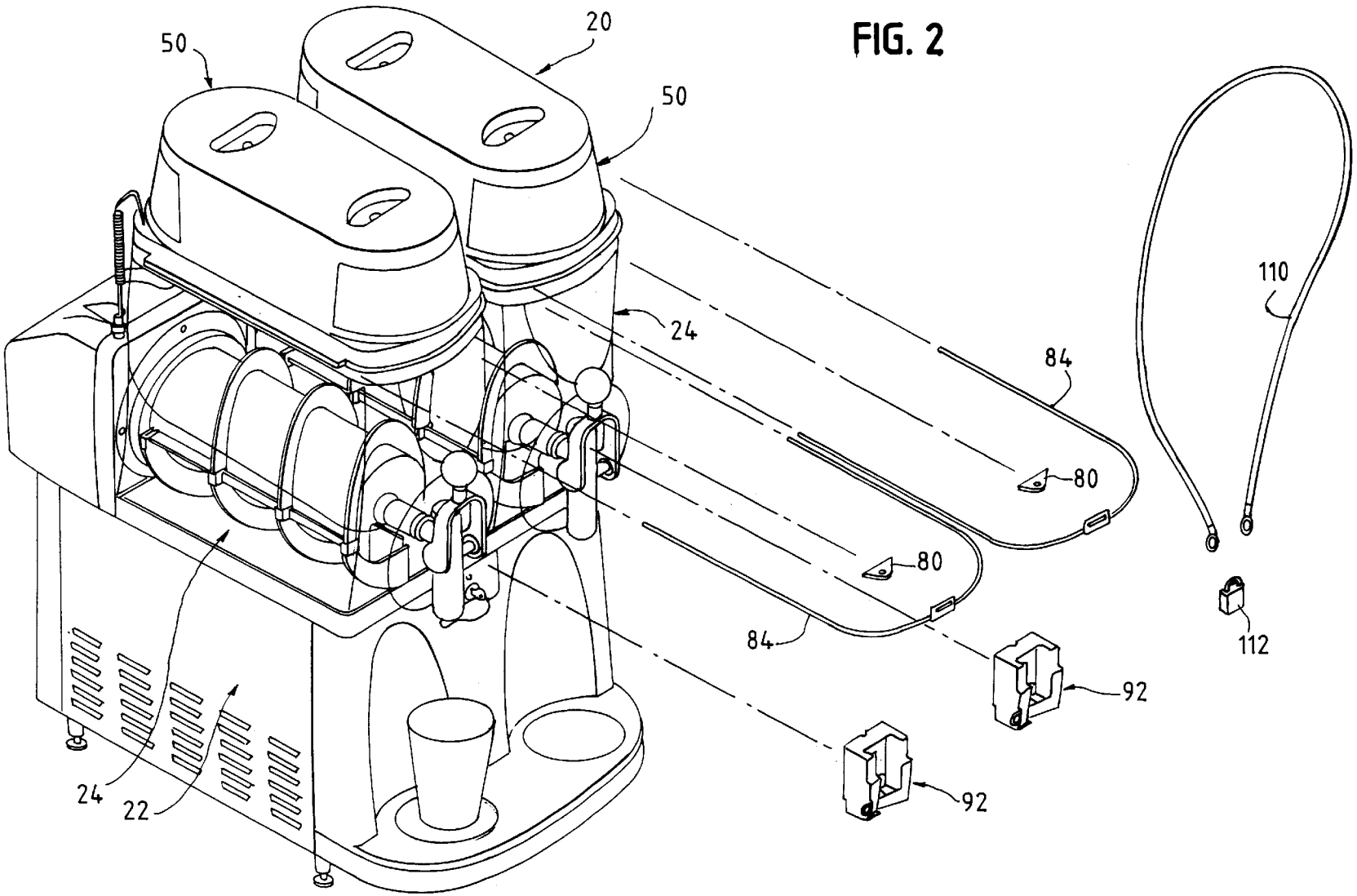
FIG. 2 is a perspective view of a cold drink system, showing the lock structure exploded therefrom in perspective.
Figure 4:
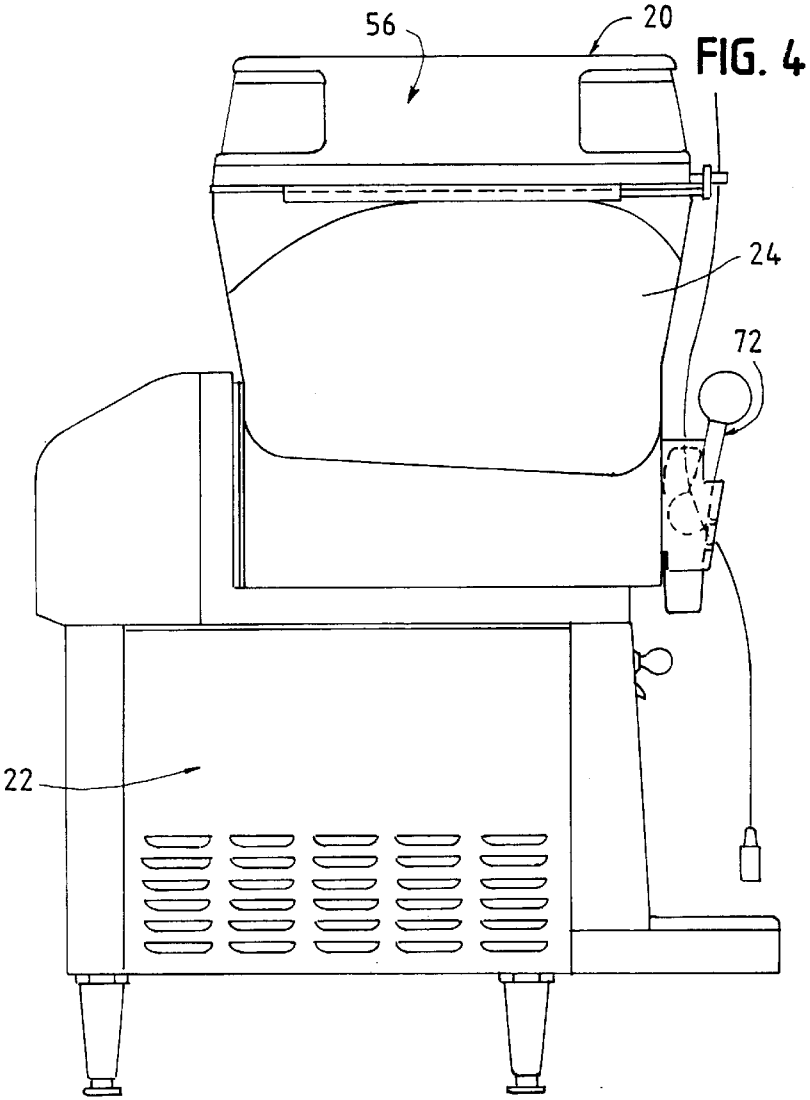
FIG. 4 is a front elevational view of a cold drink system which has the lock structure mounted thereon which incorporates the features of the invention.
Figure 3:
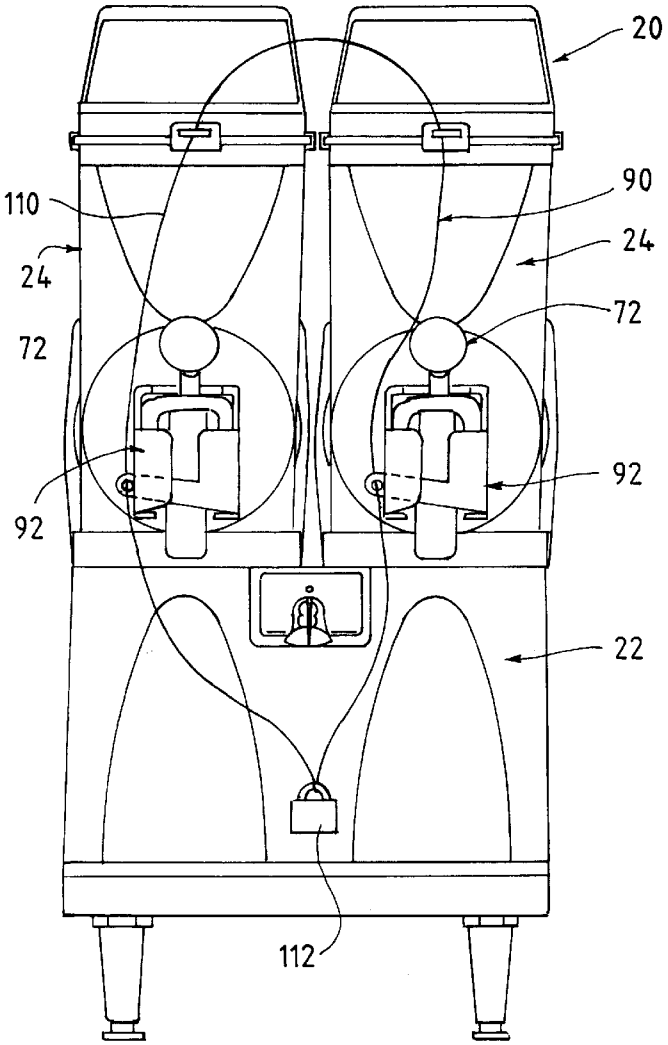
FIG. 3 is a front elevational view of a cold drink system which has the lock structure mounted thereon which incorporates the features of the invention.
Figure 5:
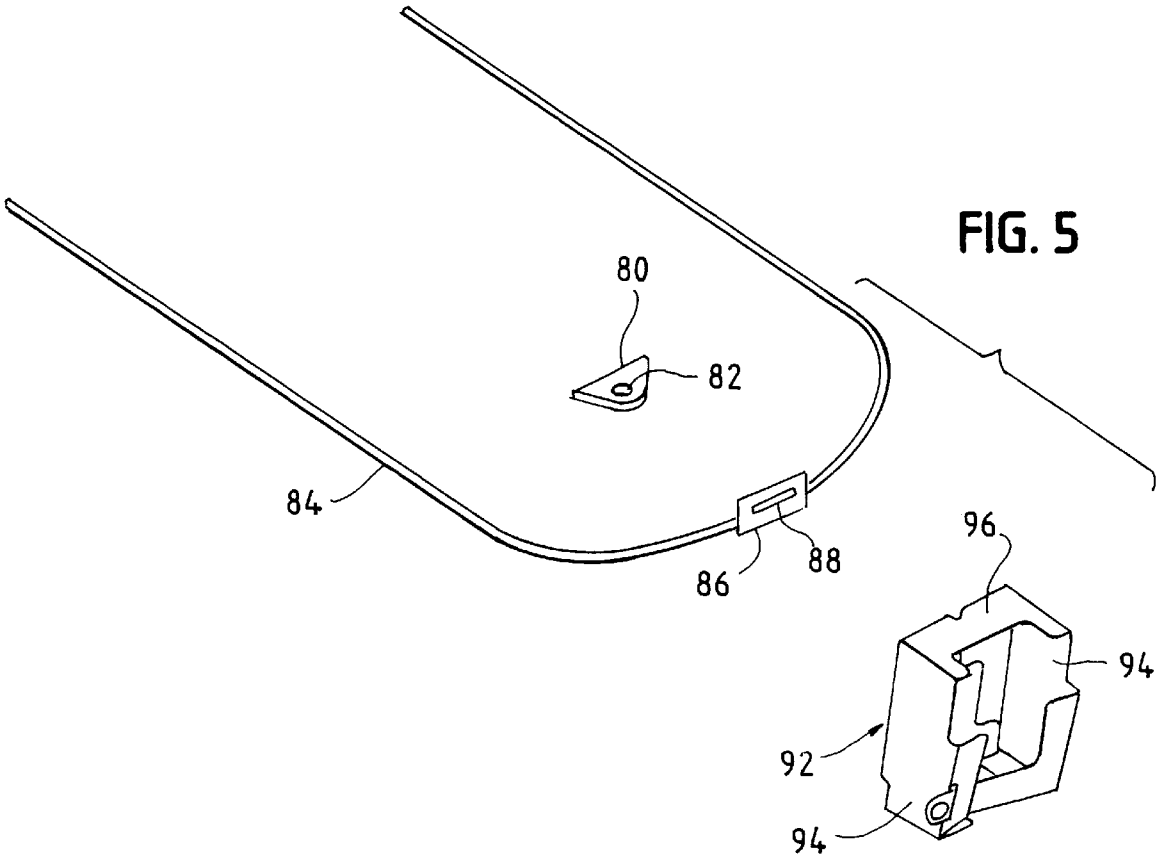
FIG. 5 is an enlarged exploded view of a portion of the lock structure.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

FIG. 1 shows a perspective view of a cold drink system 20 which incorporates the features of the present invention. The cold drink system 20 shown herein is described in United States patent application Ser. No. 09/058,449, which disclosure is herein incorporated by reference. As shown in FIG. 1, the cold drink system 20 includes a housing 22 and at least one hopper 24. Each hopper 24 is positioned on top of the housing 22 and retains a quantity of liquid or beverage ready for dispensing. In the illustrated embodiment two hoppers 24 are shown; it will be apparent to those skilled in the art, however, that it may be desirable to provide a single hopper 24 as well as three or more hoppers 24.

The housing 22 is formed from opposite side walls 26, a front wall 28 connecting the front ends of the opposite side walls 26, and a rear wall 30 connecting the rear ends of the opposite side walls 26. A dispensing area 32 for receiving a beverage or a liquid dispensed from each hopper 24 is attached to the front wall 28 of the housing 22. The dispensing area 32 may include a platform 34 on which a cup or receptacle 36 may be placed for receiving the beverage or liquid from the associated hopper 24.

Each hopper 24 is formed from a one-piece construction which includes opposite side walls 38, a front wall 40 connecting the front ends of the opposite side walls 38, and a rear wall 42 connecting the rear ends of the opposite side walls 38. The front wall 40 is curved such that the side walls 38 and the front wall 40 form a generally U-shaped profile. The rear wall 42 is also curved such that the side walls 38 and the rear wall 42 form a generally U-shaped profile. The upper end of each hopper 24 is open to define a mouth.

Figure 6:
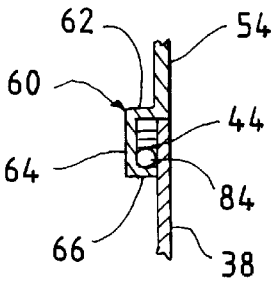
FIG. 6 is a cross-sectional view along line 5—5 of FIG. 1.

As shown in FIG. 6, a rail 44 is provided on the upper end of each side wall 38 of each hopper 24. Each rail 44 extends along substantially the entire length of the respective side wall 38.

An agitating or mixing assembly 46, which includes a blade or an auger, is provided within each hopper 24 for mixing and circulating the liquid retained within the hopper 24. A drive motor drives the agitating or mixing assembly 46 by a shaft. A. chilling assembly 48 for chilling the liquid within the hopper 24 is also provided therewithin. A coolant system for providing the chilling assembly 48 with a chilling effect is also provided.

A hopper cover 50 is positioned over the mouth of the respective hopper 24. Each hopper cover 50 is formed from a one-piece construction which includes a top wall 52 and opposite side walls 54, a front wall 56 and a rear wall 58 which depend downwardly therefrom. The front wall 56 connects the front ends of the opposite side walls 54, and the rear wall 58 connects the rear ends of the opposite side walls 54. The front wall 56 is curved such that the side walls 54 and the front wall 56 form a generally U-shaped profile. The rear wall 58 is also curved such that the side walls 54 and the rear wall 58 form a generally U-shaped profile. That is, the lower end of the hopper cover 50 generally conforms with the upper end of the hopper 24 so that when the hopper cover 50 is placed on top of the hopper 24, the mouth of the hopper 24 is completely covered by the hopper cover 50.

Each hopper cover 50 includes a pair of rail engaging members 60 which are integrally formed therewith. A rail engaging member 60 is provided at the bottom end of each side wall 54 of each hopper cover 50 and extends along substantially the entire length of the side wall 54. The structure of one of the rail engaging members 60 is described with the understanding that the other rail engaging members 60 are formed in a like manner. The rail engaging member 60 has a first flange 62 which protrudes horizontally outwardly from the bottom end of each side wall 54. A second flange 64 is connected to the outermost end of the first flange 62 and depends therefrom vertically downwardly. A third flange 66 is connected to the bottom end of the second flange 64 and projects inwardly therefrom and is parallel to the first flange 62. The flanges 62, 64, 66 form a generally flat bottomed U-shaped portion. The third flange 66 may be shorter in length than the first flange 62 such that when the hopper cover 50 is seated on the respective hopper 24, the third flange 66 is slightly spaced from the side wall 38 of the hopper 24.

The rails 44 position the hopper cover 50 on the hopper 24. To seat the hopper cover 50 onto the hopper 24, the hopper cover 50 is slid from the front of the hopper 24 toward the back of the hopper 24 and the respective rails 44 provided on the hopper 24 sit within and slide within the respective rail engaging members 60. Each rail 44 engages the respective first flange 62 and the upper portion of the second flange 64 such that the rail 44 fits snugly thereagainst. A space is provided between the rail 44 and the third flange 66 for reasons described herein. The hopper cover 50 can be removed from engagement with its associated hopper 24 by sliding the hopper cover 50 from the rear of the hopper 24 toward the front of the hopper 24. This allows a user to clean the interior of the hopper 24 and to service the hopper 24 and its components.

A dispensing faucet 68 is coupled to the front wall 40 of each hopper 24 such that the faucet 68 is positioned above the platform 34 so that the liquid or the beverage can be dispensed from the hopper 24, through the faucet 68, and into the receptacle 36. The dispensing faucet 68 includes a nozzle 70 which is connected to the front wall 40 of the hopper 24. A small space is provided between the upper portion of the nozzle 70 and the front wall 40 as a result of the curvature of the front wall 40. A valve is provided within the nozzle 70 which is opened and closed by a handle 72.

The handle 72 includes a U-shaped portion 74 and a hand grip 76. The U-shaped portion 74 has a base and opposite legs which depend downwardly therefrom. The bottom end of the legs are hingedly attached to the nozzle 70 by a pin 78 such that the U-shaped portion 74 and hand grip 76 can be rotated relative to the nozzle 70. The U-shaped portion 74 and the hand grip 76 can be rotated from a position which is proximate to the upper end of the nozzle 70 and proximate to the front wall 40 of the hopper 24, to a position which is angled relative to the nozzle 70 and angled relative to the front wall 40 of the hopper 24. The hand grip 76 includes a ball at the end of a cylindrical shaft. The cylindrical shaft is attached to the center of the base of the U-shaped portion 74. The pin 78 which hingedly attaches the handle 72 to the nozzle 70 is attached to the valve and opens or closes the valve depending on the direction in which the handle 72 is rotated.

To dispense beverage or liquid from the hopper 24, a user grips the hand grip 76 and rotates the handle 72 away from the front wall 40 of the hopper 24. Rotation of the handle 72 in this direction causes the valve to open such that beverage or liquid from within the hopper 24 can flow through the faucet 68. To stop the flow of beverage or liquid from the hopper 24, the handle 72 is rotated toward the front wall 40 of the hopper 24 until the valve is closed.

The above-described housing 22, hoppers 24, hopper covers 50 and dispensing faucets 68 are well-known in the art.

The present invention provides means for preventing an unauthorized person from separating the hopper cover 50 from the associated hopper 24 and means for preventing actuation of the dispensing faucet 68.

To prevent an unauthorized person from removing the hopper cover 50 from its associated hopper 24 when the hopper cover 50 is mounted thereon, a protuberance 80 which has an aperture 82 therethrough is mounted on the bottom end and at the center of the front wall 56 of the hopper cover 50 and protrudes outwardly therefrom. The protuberance 80 is mounted on the front wall 56 by suitable means, such as adhesive. The protuberance 80 may also be molded onto the associated hopper 24, rather than being adhesively applied.

A generally U-shaped wire 84 is which has a curved base and opposite legs extending therefrom is also provided. A flange 86 having a slot 88 therethrough is provided at the center of the base and extends upwardly therefrom. The shape of the wire 84 generally conforms with the shape of the upper end of the hopper 24. The wire 84 is preferably formed from stainless steel.

A wire 84 is attached to the each respective hopper 24 and hopper cover 50 as described herein. For clarity in the explanation, the attachment process is described with respect to one of the hoppers/hopper covers 24/50 with the understanding that the attachment of a like wire 84 to the other hopper/hopper cover 24/50 is the same. The wire 84 is attached to the hopper 24 and the hopper cover 50 by sliding the opposite legs into the respective spaces between the rails 44 and the third flanges 66 from the front end of the hopper 24 towards the rear end of the hopper 24. The wire 84 is slid until the base contacts the front wall 40 of the hopper 24.

The protuberance 80 mounted on the hopper cover 50 extends through the slot 88 in the flange 86. The flange 86 is seated between the aperture 82 through the protuberance 80 and the front wall 56 of the hopper cover 50 such that the aperture 82 is not obstructed. When the wire 84 is engaged in this manner, the respective rail engaging member 60, rail 44 and leg of the wire 84 fit snugly together.

At this point, a lock 90 is inserted into the aperture 82. This prevents the hopper cover 50 from being slid forward relative to the hopper 24 and prevents or deters removal of the hopper cover 50 from the hopper 24. The lock 90 can be removed from engagement with the protuberance 80 by an authorized person so that the hopper cover 50 can be removed from the hopper 24.

To prevent an unauthorized person from actuating the handle 72 to dispense beverage or liquid from the hopper 24, a faucet lock 92 is mounted on each dispensing faucet 68. Each faucet lock 92 is preferably formed from metal. The structure and use of the faucet lock 92 is described with respect to one faucet lock 92, with the understanding that each faucet lock 92 is identical in construction and in use.

The faucet lock 92 includes opposite vertical side walls 94*a*, 94*b* and a top wall 96 attached to the top ends of the side walls 94*a*, 94*b*. A rear portion of the top wall 96 forms a bridge between the side walls 94*a*, 94*b* to connect the side walls 94*a*, 94*b* together. A forward portion of the top wall 96 is connected to the top end of each side wall 94*a*, 94*b* and extends partially across the top of the faucet lock 92 such that the forward portions are aligned with each other, but are spaced apart from each other.

A rear wall 98 is attached to the rear end of each side wall 94*a*, 94*b*. Each rear wall 98 has an upper portion which has a greater width than the width of a lower portion thereof. The rear walls 98 are aligned with each other but are spaced apart from each other. A bottom wall 100 is attached to the bottom end of each side wall 94*a*, 94*b*. The bottom walls 100 are proximate to each other but are spaced apart from each other.

An L-shaped arm 102 is provided on the front end of one of the side walls 94*b* and a flange 104 is attached to the other of the side walls 94*a* at the front end thereof. The flange 104 has a slot 106 therethrough. A first portion of the L-shaped arm 102 is connected to the side wall 94*b* and a second portion of the L-shaped arm 102 is free and extends outwardly from the side wall 94*b*. The second portion has an aperture 108 therethrough at its free end.

Figure 8:
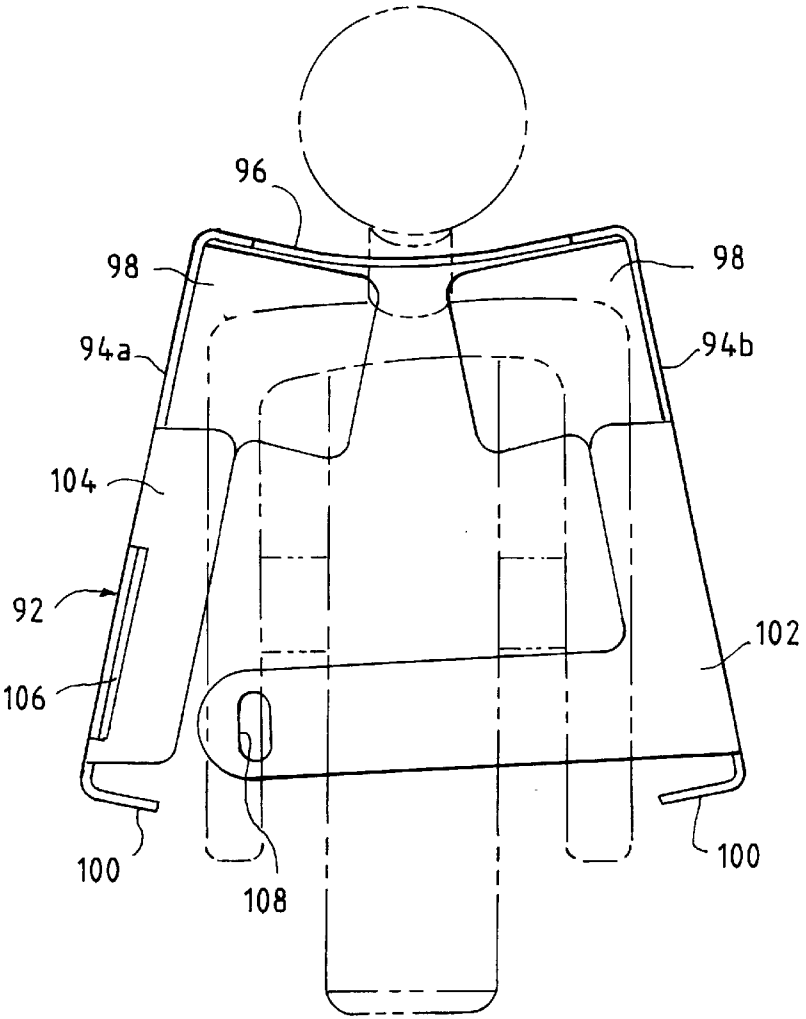
FIG. 8 is a front elevational view of another portion of the lock structure shown in a second position and surrounding the faucet which is shown in phantom lines.
Figure 7:
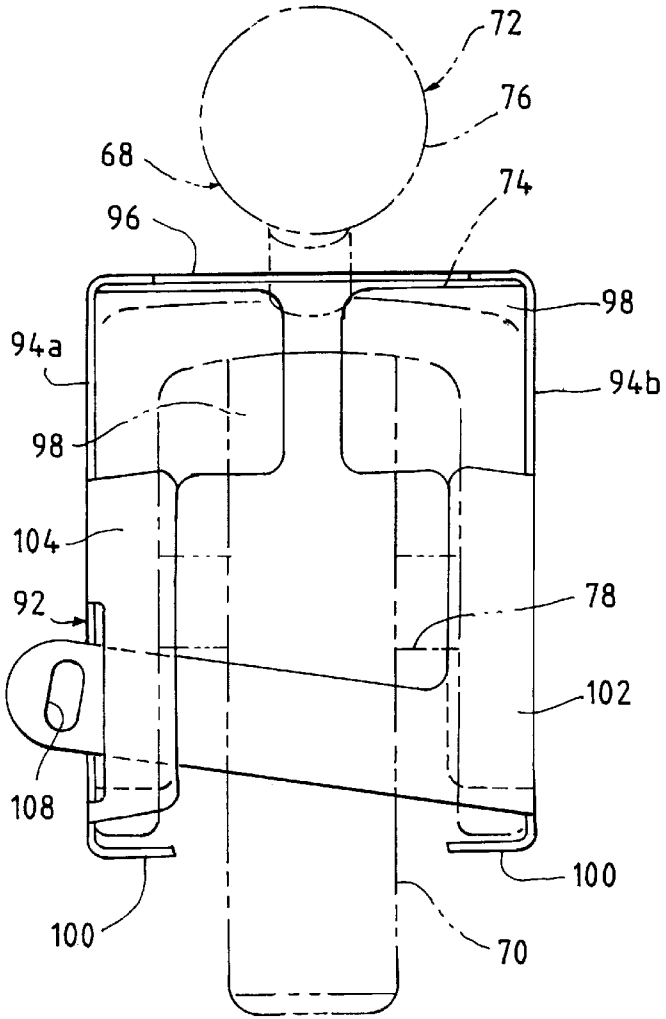
FIG. 7 is a front elevational view of another portion of the lock structure shown in a first position and surrounding a faucet which is shown in phantom lines.

The second portion of the L-shaped arm 102 can be inserted through the slot 106 in the flange 104 or can be removed from engagement with the flange 104. When engaged, the free end of the second portion extends beyond the side wall 94*a* such that the aperture 108 therethrough is not obstructed by the flange 104. To disengage the second portion from the flange 104, the side walls 94*a*, 94*b* are pulled apart from each other until the second portion is freed from engagement with the flange 104. The rear portion of the top wall 96 bows, see FIG. 8. As this occurs, the rear walls 98 also pull apart from each other. To re-engage the second portion through the slot 106 in the flange 104, the side walls 94*a*, 94*b* are pushed towards each other until the free end of the second portion slides through the flange 104.

To mount the faucet lock 92 on the respective faucet 68, the side walls 94*a*, 94*b* are pulled apart from each other until the second portion is freed from the slot 106 in the flange 104. The side walls 94*a*, 94*b* of the faucet lock 92 are then positioned on the respective sides of the U-shaped 74 of the handle 72. The upper portion of each rear wall 98 sits on top of the connection point between the nozzle 70 and the front wall 40 of the hopper 24 and the lower portion of each rear wall 98 sits on either side of the connection point between the nozzle 70 and the front wall 40 of the hopper 24. The side walls 94*a*, 94*b* are then pushed towards each other until the free end of the L-shaped arm 102 is inserted into the slot 106 in the flange 104 such that the aperture 108 extends beyond the flange 104 is not obstructed thereby and such that the side walls 94*a*, 94*b* sit against the legs of the U-shaped portion 74. The interiors of the L-shaped arm 102 and the flange 104 abut against the outer surface of the legs of the U-shaped portion 74. The rearward portion of the top wall 96 is positioned between the shaft of the hand grip 76 and the front wall 40 of the hopper 24. The forward portions of the top wall 96 sit on top of the opposite ends of the base of the U-shaped portion 74. The bottom walls 100 are positioned underneath the ends of the legs of the U-shaped handle 74. That is to say, the faucet lock 92 closely surrounds the handle 72. At this point, a lock 90 is inserted into the aperture 108 in the free end of the L-shaped arm 102 and hangs from the free end of the second portion. This prevents an unauthorized user from actuating the dispensing faucet 68 because the handle 72 cannot be rotated. The lock 90 can be removed from the free end of the L-shaped arm 102 by an authorized person so that the faucet 68 can be actuated by rotation of the handle 72.

As shown, the lock 90 can take the form of a cable 110 which is inserted through the apertures 82 in each protuberance 80 and through the apertures 108 in the free ends of the L-shaped arms 102 and which ends are secured together by a padlock 112. Additionally, individual locks can be mounted on the protuberances 80 and on the L-shaped portions 108. Moreover, the lock 90 can take the form of a cable having an end which is enlarged and which is inserted through the aperture 108 in one of the faucet locks 92 such that the enlarged end rests against the one faucet lock 92, through both protuberances 80 and through the other faucet lock 92 at which point the other end of the cable is fitted with a padlock.

It is to be understood that the hoppers 24, the hopper covers 50 and the wires 84 can have other profiles than that which is shown in the drawings. In addition, it is to be understood that the flange 104 can be eliminated and the slot 106 be provided through the side wall 94*a*. Moreover, it is to be understood that the protuberance 80 can be mounted on hopper 24 and the slot 88 being provided on the underside of the wire 84 such that the protuberance 80 and the flange 86 can be engaged with each other.

While a preferred embodiment of the present invention is shown and described, it is envisioned that those skilled in the art may devise various modifications of the present invention without departing from the spirit and scope of the appended claims.

The invention claimed is:

1. A cold drink system for chilling a liquid comprising:

a hopper for retaining a quantity of liquid;

a dispensing faucet connected to said hopper for dispensing liquid from said hopper;

a dispensing faucet locking device comprising first and second side walls;

a top wall connected to and extending between said first and second side walls;

first and second back walls attached to and extending from a rear portion of said first and second side walls, respectively;

first and second bottom walls extending from a bottom portion of said first and second side walls, respectively;

an arm extending from a front portion of one of said first and second side walls toward the other of said first and second side walls;

a portion of said dispensing faucet locking device defining an opening for receiving said arm;

a free end of said arm defining an aperture therethrough;

said free end of said arm extending through said opening past said aperture on said arm for receiving a structure through said aperture to prevent actuation of said dispensing faucet.

2. A cold drink system as defined in claim 1, wherein said dispensing faucet locking device comprises a member which can be attached to said dispensing faucet and removed from said dispensing faucet.

3. A cold drink system as defined in claim 2, wherein said member includes a housing which fits around and abuts portions of said dispensing faucet when engaged therewith.

4. A cold drink system as defined in claim 3, wherein said housing includes a slot therein and an arm which can be can engaged with said slot, said arm having an aperture therethrough through which a lock is engaged to lock said housing to said dispensing faucet.

5. A cold drink system as defined in claim 4, wherein said lock includes a cable which is positioned through said aperture and having at least one end thereof having a padlock attached thereto.

6. A cold drink system for chilling a liquid comprising:

a hopper for retaining a quantity of liquid, a portion of said hopper defining a mouth;

a hopper cover for covering said mouth of said hopper, said hopper cover being removable from said hopper;

a dispensing faucet connected to said hopper for dispensing liquid from said hopper;

a dispensing faucet locking device comprising first and second side walls;

a top wall connected to and extending between said first and second side walls;

first and second back walls attached to and extending from a rear portion of said first and second side walls, respectively;

first and second bottom walls extending from a bottom portion of said first and second side walls, respectively;

an arm extending from a front portion of one of said first and second side walls toward the other of said first and second side walls;

a portion of said dispensing faucet locking device defining an opening for receiving said arm;

a free end of said arm defining an aperture therethrough, said free end of said arm extending through said opening past said aperture on said arm for receiving a structure through said aperture to prevent removal of said locking device from said faucet; and means attachable to said hopper and to said hopper cover for retaining said hopper cover on said hopper, said hopper cover retaining means being disengageable from said hopper and said hopper cover to enable removal of said hopper cover from said hopper, said hopper cover retaining means being engageable with said locking device for preventing removal of said hopper cover.

7. A cold drink system as defined in claim 6, wherein said dispensing faucet locking device includes a housing which fits around and abuts portions of said dispensing faucet when engage therewith.

8. A cold drink system as defined in claim 7, wherein said housing includes a slot therethrough and an arm which can be can engaged with said slot, said arm having an aperture therethrough through which a lock is engaged to lock said housing to said dispensing faucet.

9. A cold drink system as defined in claim 8, wherein said lock includes a cable which is positioned through said aperture and having at least one end thereof having a padlock attached thereto.

10. A cold drink system as defined in claim 6, wherein said hopper includes an upstanding wall and a rail extending outwardly from said upstanding wall, and said retaining means engages against said rail.

11. A cold drink system as defined in claim 10, wherein one of said hopper cover or said hopper further includes a protuberance protruding outwardly therefrom, and said retaining means is a wire which surrounds said hopper cover when attached thereto, said wire engaging said protuberance and being secured thereto.

12. A cold drink system as defined in claim 11, wherein said protuberance has an aperture therethrough and said wire has an aperture therethrough, and wherein said protuberance is positioned through the aperture provided through said wire when said wire is attached to said hopper and hopper cover, and further including a lock is inserted through the aperture provided through said protuberance when said wire is attached to said hopper and hopper cover.

13. A cold drink system as defined in claim 12, wherein said lock includes a cable which is positioned through said aperture provided through said protuberance and at least one end of said cable having a padlock attached thereto when said wire is attached to said hopper and hopper cover.

14. A cold drink system for chilling a liquid comprising:

a hopper for retaining a quantity of liquid, said hopper an upstanding wall, a mouth at an end thereof, and at least one rail extending outwardly from said upstanding wall;

a hopper cover for covering said mouth of said hopper, said hopper cover having wall, said hopper cover being removable from said hopper;

a protuberance protruding outwardly from one of said hopper cover or said hopper, said protuberance having an aperture therethrough;

a dispensing faucet connected to said hopper for dispensing liquid from said hopper; and a housing which can be attached to and which snugly fits around said dispensing faucet when engaged therewith to prevent actuation of said dispensing faucet, said housing being capable of being removed from said dispensing faucet to permit actuation of said dispensing faucet, said housing including a slot therethrough and an arm which can be can engaged with said slot, said arm having an aperture therethrough; and a wire engageable against said at least one rail and engageable against said hopper cover for retaining said hopper cover on said hopper, said wire being disengageable from said at least one rail and said hopper cover to enable removal of said hopper cover from said hopper, said wire surrounding said hopper cover when attached thereto, said wire engaging said protuberance; and a cable engaged through said aperture in said free end of said arm and through said aperture in said protuberance, said cable having free ends which are locked by a lock.

15. A dispensing faucet locking device comprising:

first and second side walls;

a top wall connected to and extending between said first and second side walls;

first and second back walls attached to and extending from a rear portion of said first and second side walls, respectively;

first and second bottom walls extending from a bottom portion of said first and second side walls, respectively;

an arm extending from a front portion of one of said first and second side walls toward the other of said first and second side walls;

a portion of said dispensing faucet locking device defining an opening for receiving said arm;

a free end of said arm defining an aperture therethrough;

said free end of said arm extending through said opening past said aperture on said arm for receiving a structure through said aperture to prevent actuation of said dispensing faucet.

16. A dispensing faucet locking device as defined in claim 15, wherein one of said first and second side walls has, extending from its front edge, a flange to prevent actuation of said dispensing faucet device.

17. A dispensing faucet locking device comprising:

first and second side walls;

a top wall connected to and extending between said first and second side walls;

at least one rear retaining structure attached to and extending from a rear portion of at least one of said first and second side walls, respectively, for preventing forward removal of said locking device from said faucet;

at least one bottom retaining structure extending from a bottom portion of at least one of said first and second side walls, respectively, for preventing upward removal of said locking device from said faucet;

an arm extending from a front portion of one of said first and second side walls toward the other of said first and second side walls;

means for retaining said arm, said arm retaining means positioned for receiving a free end of said arm to prevent removal of said locking device from said dispensing faucet.

18. In combination with a cold drink system for chilling a liquid, a hopper for retaining a quantity of liquid, a portion of said hopper defining a mouth, a hopper cover for covering said mouth of said hopper, said hopper cover being removable from said hopper;

means engageable with said hopper and said hopper cover for preventing removal of said hopper cover from said hopper;

said retaining means being substantially separate from said hopper and said hopper cover; and said retaining means being disengageable from said hopper and said hopper cover to enable removal of said hopper cover from said hopper.

19. A cold drink system as defined in claim 18, wherein said hopper includes an upstanding wall and a rail extending outwardly from said upstanding wall, and said retaining means engages against said rail.

20. A cold drink system as defined in claim 19, wherein one of said hopper cover or said hopper further includes a protuberance protruding outwardly therefrom, and said retaining means is a wire which surrounds said hopper cover when attached thereto, said wire engaging said protuberance and being secured thereto.

21. A cold drink system as defined in claim 20, wherein said protuberance has an aperture therethrough and said wire has an aperture therethrough, and wherein said protuberance is positioned through the aperture provided through said wire when said wire is attached to said hopper and hopper cover, and further including a lock inserted through the aperture provided through said protuberance when said wire is attached to said hopper and said hopper cover.

22. A cold drink system as defined in claim 21, wherein said lock includes a cable which is positioned through said aperture provided in said protuberance and at least one end of said cable having a lock attached thereto when said wire is attached to said hopper and hopper cover.

* * * * *